US008797188B2

(12) United States Patent
Lee

(10) Patent No.: US 8,797,188 B2
(45) Date of Patent: Aug. 5, 2014

(54) LOW POWER OPERATED LOOP TYPE VEHICLE DETECTING APPARATUS INCLUDING A COUNT CONTROLLER

(75) Inventor: Jeong Jun Lee, Gunpo-si (KR)

(73) Assignee: Moru Inven Co., Ltd., Gunpo-Si (KR)

( * ) Notice: Subject to any disclaimer, the term of this patent is extended or adjusted under 35 U.S.C. 154(b) by 214 days.

(21) Appl. No.: 13/501,984

(22) PCT Filed: Jan. 26, 2010

(86) PCT No.: PCT/KR2010/000468

§ 371 (c)(1),
(2), (4) Date: Apr. 13, 2012

(87) PCT Pub. No.: WO2011/046266

PCT Pub. Date: Apr. 21, 2011

(65) Prior Publication Data

US 2012/0200432 A1 Aug. 9, 2012

(30) Foreign Application Priority Data

Oct. 14, 2009 (KR) ..... 10-2009-0097587

(51) Int. Cl.
*G08B 21/00* (2006.01)

(52) U.S. Cl.
USPC ..... 340/941; 340/933

(58) Field of Classification Search
CPC ..... G08G 1/042; G01V 3/101
USPC ..... 340/933, 941; 324/207.15, 207.16; 333/65, 165
See application file for complete search history.

(56) References Cited

U.S. PATENT DOCUMENTS 7,014,355 B2 * 3/2006 Potter et al. ..... 368/90

FOREIGN PATENT DOCUMENTS

| | | | |
|---|---|---|---|
| JP | 07-105475 | A | 4/1995 |
| JP | 2008-293460 | A | 12/2008 |
| KR | 10-0340985 | B1 | 11/2002 |
| KR | 10-0413053 | B1 | 12/2003 |
| KR | 10-0418458 | B1 | 2/2004 |
| KR | 10-2006-0055149 | A | 5/2006 |

OTHER PUBLICATIONS

International Search Report for International Application No. PCT/KR2010/000468.

* cited by examiner

*Primary Examiner* — Jeffery Hofsass
(74) *Attorney, Agent, or Firm* — LRK Patent Law Firm

(57) ABSTRACT

The present invention relates to a low power operated loop type vehicle detecting apparatus, and particularly, to a low power operated loop type vehicle detecting apparatus that comprises an LC resonator with a loop coil installed in a detecting area, a resonance oscillation circuit unit, and a vehicle behavior determination unit. The vehicle detecting apparatus further comprises: a behavior determination clock generator for generating a behavior determination clock; a count controller for setting clock count time in a steady-state period; a behavior determination clock counter for counting the behavior determination clock during the clock count time set by the count controller; and a vehicle behavioral state determiner for determining a vehicle behavioral state in a detecting area, based on the counting value of the behavior determination clock counter. Power consumption can thereby be reduced.

4 Claims, 3 Drawing Sheets

LOW POWER OPERATED LOOP TYPE VEHICLE DETECTING APPARATUS INCLUDING A COUNT CONTROLLER

TECHNICAL FIELD

The present invention relates to a low power operated loop type vehicle detecting apparatus, and more particularly, to an apparatus for detecting a vehicle behavior (a parked state, a stopped state, a passing state of a vehicle, or the like) using variations in inductance of a loop coil installed in a detecting area.

BACKGROUND ART

Vehicle detecting apparatuses have been used to acquire traffic information or use in of a parking lot. As these vehicle detecting apparatuses, a loop type vehicle detecting apparatus for detecting a vehicle behavior parked state, a stopped state, a passing state of a vehicle, or the like) by using variations in inductance of a loop coil that is mounted in a detecting area (a parked area, a stopped area, or a passing area of a vehicle) has been proposed.

FIG. 3 is a functional block diagram of a low power operated loop type vehicle detecting apparatus in accordance with the related art.

As shown in FIG. 3, the loop type vehicle detecting apparatus in accordance with the related art is configured to include a resonance oscillation circuit unit 110 that includes an LC resonator 111 including a loop coil 111*a* mounted in a detecting area and an oscillator 112 connected with the LC resonator 111 and a vehicle behavior determination unit 120 connected with the resonance oscillation circuit unit 110.

The loop coil 111*a* is connected with a protective circuit (not shown) for preventing overcurrent due to lightning from flowing into the resonance oscillation circuit unit 110.

The LC resonator 111 is resonated with a resonance frequency that varies with a change in an inductance, value of the loop coil 111*a*. The inductance value of the loop coil 111*a* is reduced when metal components of a vehicle electromagnetically interact with the loop coil 111*a*. As a result, when a vehicle accesses the loop coil 111*a*, the resonance frequency of the LC resonator 111 is increased.

The LC resonator 111 having the above configuration may include frequency selective characteristics by impedance matching.

The oscillator 112 is oscillated with a frequency that varies with the change in the resonance frequency of the LC resonator 111.

The oscillator 112 is continuously applied with operating voltage.

A frequency of an analog oscillator signal that is output from the oscillator 112 is increased when the vehicle accesses the loop coil 111*a* (when the vehicle accesses the loop coil, the resonance frequency of the LC resonator is increased).

The vehicle behavior determination unit 120 is configured to include an analog-digital converter 121 that converts an analog oscillation signal output from the resonance oscillation circuit unit 110 into a digital oscillation signal of the same frequency, an oscillation clock counter 127 that counts a clock of the digital oscillation signal converted in the analog-digital converter 121, and a vehicle behavioral state determiner 125 that determines a vehicle behavioral state based on the number of digital oscillation signal clocks counted in the oscillation clock counter 127.

The vehicle behavioral state determiner 125 determines a vehicle behavioral state by calculating the frequency by dividing the number of digital oscillation signal clocks counted in the oscillation clock counter 127 by a predetermined time (usually, 10 to 100 msec) and comparing the calculated frequency with the preset number of vehicle behavior reference clocks stored in a memory.

However, according to the low power operated loop type vehicle detecting apparatus, the operating voltage is continuously applied to the oscillator 112, which may lead to the increase in power consumption.

As such, when the power consumption is increased, a secondary problem of frequently replacing a voltage source occurs.

DISCLOSURE

Technical Problem

Therefore, the present invention has been made in view of the above-mentioned problems, and an aspect of the present invention is to provide a low power operated loop type vehicle detecting apparatus capable of reducing power consumption.

Technical Solution

In accordance with an aspect of the present invention, there is provided a low power operated loop type vehicle detecting apparatus, including: a resonance oscillation circuit unit that includes an LC resonator having a loop coil mounted in a detecting area and an oscillator connected with the LC resonator and generates an analog oscillation signal having a frequency determined according to an inductance value of the loop coil; and a vehicle behavior determination unit that determines a vehicle behavior in a detecting area based on the analog oscillation signal output from the resonance oscillation circuit unit, wherein the vehicle behavior determination unit includes: a behavior determination clock generator that generates a behavior determination clock having a frequency larger than the analog oscillation signal output from the resonance oscillation circuit unit; a count controller that periodically turns-on/off operating voltage supplied to the oscillator and sets clock count time in a steady-state period of the analog oscillation signal output from the resonance oscillation circuit unit; a behavior determination clock counter that counts the behavior determination clock generated in the behavior determination clock generator for the clock count time set in the count controller; and a vehicle behavioral state determiner that determines a vehicle behavioral state in a detecting area based on a count value in the behavior determination clock counter or an analog-digital converter that converts an analog oscillation signal output from the resonance oscillation circuit unit into a digital oscillation signal; a counter controller that periodically turns-on/off operating voltage supplied to the oscillator and sets the clock count time based on a digital oscillation signal period corresponding to a steady-state period of an analog oscillation signal output to the resonance oscillation circuit unit in the digital oscillation signal output from the analog-digital converter; a behavior determination clock counter that counts the digital oscillation signal generated in the analog-digital converter for the clock count time set in the count controller; and a vehicle behavioral state determination unit that determines a vehicle behavioral state in a detecting area based on the count value in the behavior determination clock counter.

The count controller may control the behavior determination clock generator so as to stop a generation of the behavior determination clock at a time out of the clock count time, thereby further reducing cower consumption.

The analog-digital converter may generate divider digital oscillation signal having a 1/N (N=integer of 2 or more) frequency of the analog oscillation signal output from the resonance oscillation circuit unit; and the count controller may set the clock count time by using count starting pulse position information that indicates whether the count starting pulse at which the count of the behavior determination clock counter starts corresponds to an n-th pulse, starting from the first pulse of the divider digital oscillation signal and count ending pulse position information that indicates whether the count ending pulse at which the count of the behavior determination clock counter ends corresponds to an n-th pulse, starting from the first pulse of the divider digital oscillation signal, thereby accurately setting the clock count time.

Advantageous Effects

A low bower operated loop type vehicle detecting apparatus according to at least one embodiment of the present invention as described above can periodically turn-on/off the operating voltage supplied to the oscillator and set the clock count time in the steady state period of the analog oscillation signal output from the resonance oscillation circuit unit, thereby reducing the power consumption.

BRIEF DESCRIPTION OF THE DRAWINGS

The foregoing and other objects, features and advantages of the present invention will become more apparent from the following detailed description when taken in conjunction, with the accompanying drawings in which.

REFERENCE NUMERALS OF IMPORTANT ELEMENTS IN THE DRAWINGS

Figure 1:
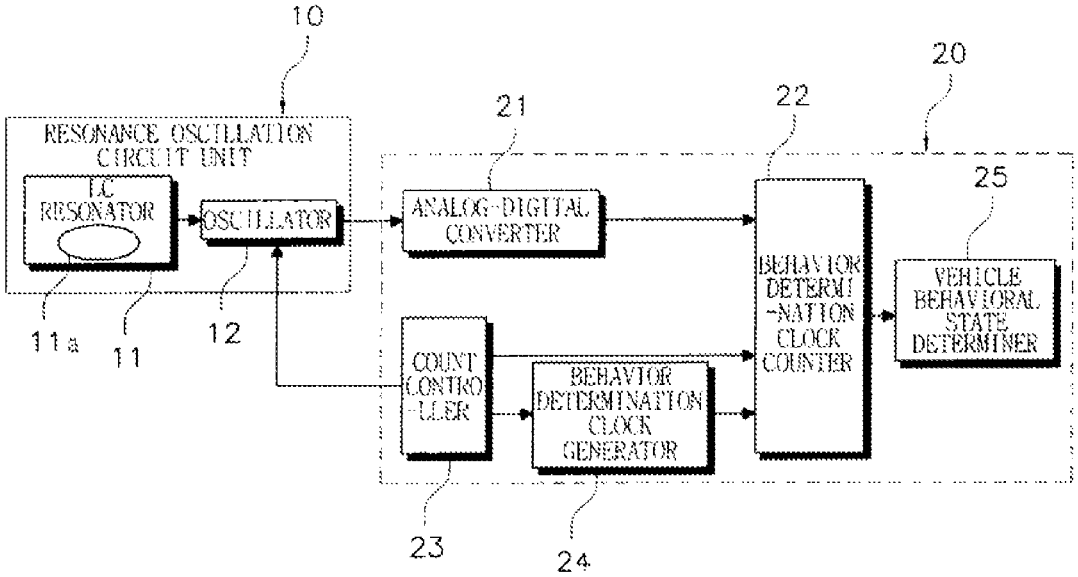
FIG. 1 is a functional block diagram of a low power operated loop type vehicle detecting apparatus in accordance with an embodiment of the present invention.

10, 110: resonance oscillation circuit unit
11, 111: LC resonator
12, 112: oscillator
20, 120: vehicle behavior determination unit
21, 121: analog-digital converter
22: behavior determination clock counter
23: count controller
24: behavior determination clock generator
25, 125: vehicle behavioral state determiner
127: oscillation clock counter

BEST MODE

Mode for Invention

Embodiments of the present invention will now be described in detail with reference to the accompanying drawings.

Figure 2:
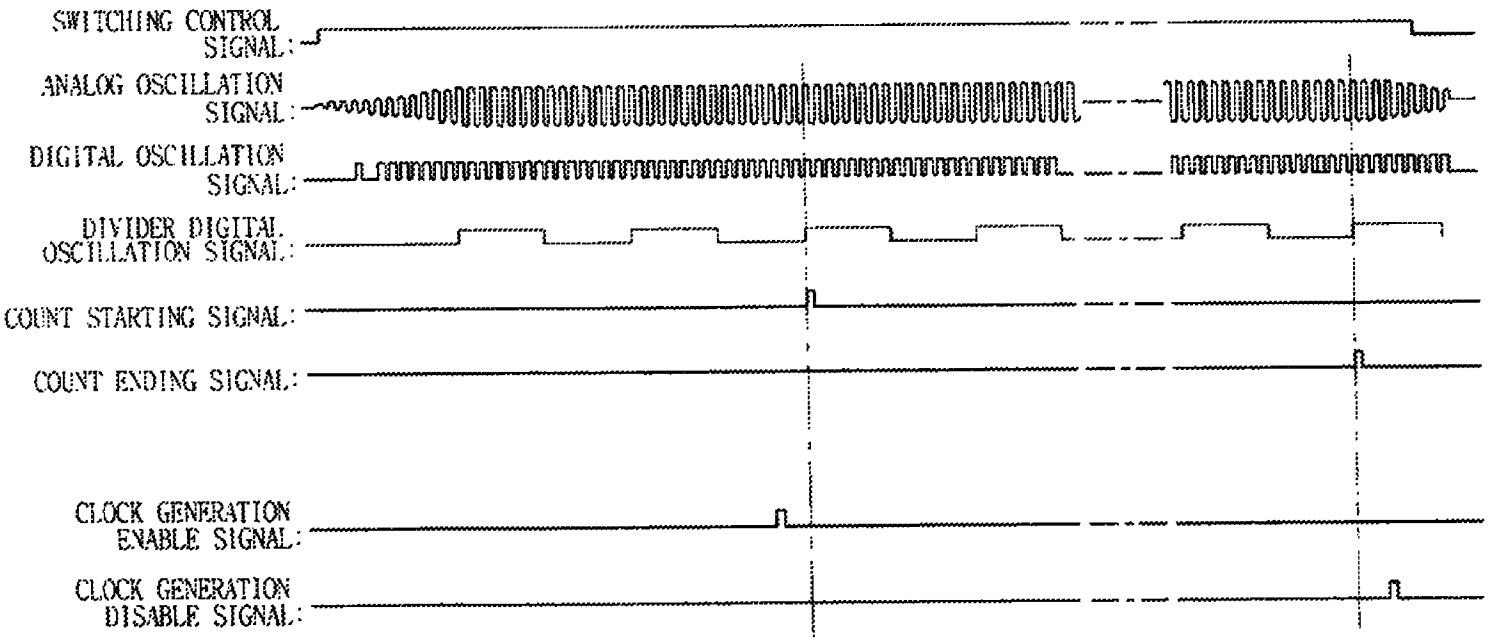
FIG. 2 is a timing chart of the low power operated loop type vehicle detecting apparatus in accordance with an embodiment of the present invention.
Figure 3:
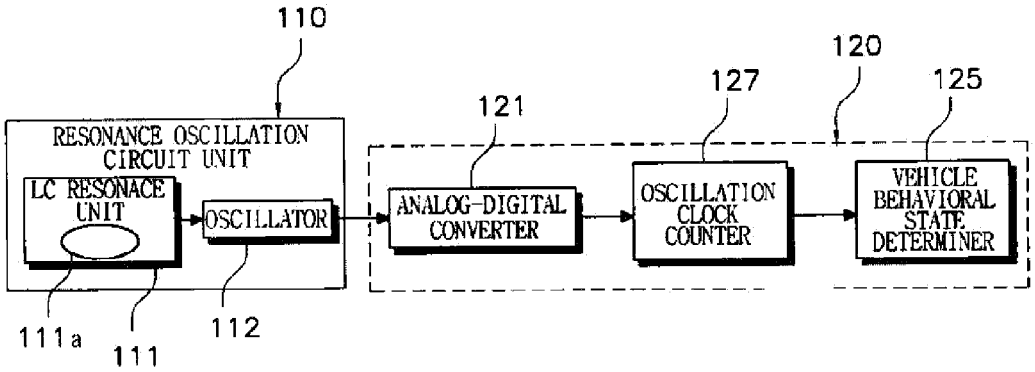
FIG. 3 RELATED ART
FIG. 3 is a functional block diagram of a low power operated loop type vehicle detecting apparatus in accordance with the related amt.

FIG. 1 is a functional block diagram of a low power operated loop type vehicle detecting apparatus in accordance with an embodiment of the present invention and FIG. 2 is a timing chart of the low power operated loop type vehicle detecting apparatus in accordance with an embodiment of the present invention.

As shown in these figures, a loop type vehicle detecting apparatus according to an embodiment of the present invention is configured to include a resonance oscillation circuit unit 10 that includes an LC resonator 11 including a loop coil 11*a* mounted in a detecting area and an oscillator 12 connected with the LC resonator 11 and a vehicle behavior determination unit 20 connected with the resonance oscillation circuit unit 10.

The loop coil 11*a* is connected with a protective circuit (not shown) for preventing overcurrent due to lightning from flowing into the resonance oscillation circuit unit 10.

The LC resonator 11 is resonated with a resonance frequency that varies with a change in an inductance value of the loop coil 11*a*. The inductance value of the loop coil 11*a* is reduced when metal components of a vehicle electromagnetically interact with the loop coil 11*a*. As a result, when a vehicle accesses the loop coil 11*a*, the resonance frequency of the LC resonator 11 is increased.

The LC resonator 11 having the above configuration may include frequency selective characteristics by serial resonance, parallel resonance, and impedance matching.

The oscillator 12 is oscillated with a frequency that varies with the change in the resonance frequency of the LC resonator 11.

Further, the oscillator 12 is periodically applied with operating voltage according to a switching control signal of a count controller 23.

A frequency of an analog oscillator signal that is output from the oscillator 12 is increased when the vehicle accesses the loop coil 11*a* (when the vehicle accesses the loop coil 11*a*, the resonance frequency of the LC resonator is increased). In this case, the frequency of the analog oscillation signal may be usually selected at several tens of KHz to several hundreds of KHz.

The vehicle behavior determination unit 20 may be configured to include: an analog-digital converter 21 that is connected to an output end of the resonance oscillation circuit unit 10; a behavior determination clock generator 24 that generates a behavior determination clock; a behavior determination clock counter 22 that counts the behavior determination clock generated in the behavior determination clock generator 24; a count controller 23 that controls a count operation of the behavior determination clock counter 22 and a clock generation operation of the behavior determination clock generator 24, and a vehicle behavioral state determiner 25 that determines the vehicle behavioral state in a detecting area based on a count value in the behavior determination clock counter 22.

The analog-digital converter 21 converts the analog oscillation signal output from the resonance oscillation circuit unit 10 by the following method.

First, a steady-state period (a period having an amplitude of 63.2% or more) of the analog oscillation signal is selected in consideration of a time constant of the resonance oscillation circuit unit 10.

Next, the digital oscillation signal having the same frequency as the frequency in the steady-state period is generated in the selected steady-state period (see FIG. 2).

Next, the digital oscillation signal, having the same frequency as the frequency in the steady-state period is 16-divided by a predetermined division circuit to generate a divider digital oscillation signal (see FIG. 2).

The behavior determination clock generator 24 may be configured to generate the behavior determination clock having a frequency 100 to 1000 times higher than the frequency of the analog oscillation signal.

Further, the behavior determination clock generator 24 starts to generate the behavior determination clock when a clock generation enable signal to be described below is input from the count controller 23 and stops generating the behavior determination clock when; clock generation disable signal to be described below is input from the count controller 23 (see FIG. 2).

The behavior determination clock counter 22 starts to count the behavior determination clock when a count starting signal to be described bellow is transferred from the count controller 23 and ends the count of the behavior determination clock when a count ending signal to be described below is transferred from the count controller 23. A clock count time is between the count starting signal and the count ending signal.

The count controller 23 controls a switching operation of a voltage switching circuit unit (not shown) that generates a switching control sign for periodically turning-on/off operating voltage supplied to the oscillator 12 to supply the operating voltage to the oscillator 12 and an oscillation operation of the oscillator 12.

The clock count time is set by using count starting pulse position information (Start=3) that indicates whether the count starting pulse at which the count of the behavior determination clock counter 22 starts corresponds to an n-th pulse, starting from the first pulse of the divider digital oscillation signal and count ending pulse position information (Stop=53) that indicates whether the count ending pulse at which the count of the behavior determination clock counter 22 ends corresponds to an n-th pulse, starting from the first pulse of the divider digital oscillation signal.

That is, the counter controller 23 generates the count starting signal at the count starting pulse position (Start=3) and transfers the generated count starting signal to the behavior determination clock counter 22 and generates the count ending signal at the count ending pulse position (Stop=53) and transfers the generated count ending signal to the behavior determination clock counter 22 (see FIG. 2).

Further, the count controller 23 generates the clock generation enable signal for starting the clock generation in the behavior determination clock generator 24 immediately before the count starting pulse position (Start=3), transfers the generated clock generation enable signal to the behavior determination clock generator 24, generates the clock generation disable signal for ending the clock generation in the behavior determination clock generator 24 immediately after the count ending pulse position (stop=53), and transfers the generated clock generation disable signal to the behavior determination clock generator 24 (see FIG. 2).

The vehicle behavioral state determiner 25 determines the vehicle behavioral state by the following method.

First, the vehicle behavioral state is determined by comparing the number of behavior determination clocks counted in the behavior determination clock counter 22 with the preset number of vehicle behavior reference clocks that are stored in the memory.

The vehicle behavioral state determined in the vehicle behavioral state determiner 25 is transferred to an upper system in a wired manner or a wireless manner, so that the transferred information is used as traffic volume information and parking information.

Meanwhile, in the aforementioned embodiment, the behavior determination clock is counted in the behavior determination clock generator 24 to determine the vehicle behavioral state, but the vehicle behavioral state may be determined by counting the digital oscillation signal output from the analog-digital converter 21, while omitting the behavior determination clock generator 24.

As described above, according to the embodiment of the present invention, the operating voltage supplied to the oscillator 12 is periodically turned-on/off and the clock count time is set in the steady-state period of the analog oscillation signal output from the resonance oscillation circuit 10, thereby reducing the power consumption.

In addition, the behavior determination clock generator 24 stops the generation of the behavior determination clock at a time out of the clock count time, thereby further reducing the power consumption.

Further, the divider digital oscillation signal is generated in the analog-digital converter 21 and the clock count time and accurately determining the vehicle behavioral state.

INDUSTRIAL APPLICABILITY

The embodiment of the present invention can use the low power operated loop type vehicle detecting apparatus including the LC resonator, the resonance oscillation circuit unit, and the vehicle behavior determination unit to periodically turn-on/off the operating voltage supplied to the oscillator and set the clock count time in the steady-state period of the analog oscillation signal output from the resonance oscillation circuit unit, thereby reducing the power consumption.

The invention claimed is:

1. A low power operated loop type vehicle detecting apparatus, comprising:

a resonance oscillation circuit unit that includes an LC resonator having a loop coil mounted in a detecting area and an oscillator connected with the LC resonator and generates an analog oscillation signal having a frequency determined according to an inductance value of the loop coil; and a vehicle behavior determination unit that determines a vehicle behavior in a detecting area based on the analog oscillation signal output from the resonance oscillation circuit unit, wherein the vehicle behavior determination unit comprises:

a behavior determination clock generator that generates a behavior determination clock having a frequency larger than the analog oscillation signal output from the resonance oscillation circuit unit;

a count controller that periodically turns-on/off operating voltage supplied to the oscillator and sets clock count time in a steady-state period of the analog oscillation signal output from the resonance oscillation circuit unit;

a behavior determination clock counter that counts the behavior determination clock generated in the behavior determination clock generator for the clock count time set in the count controller; and a vehicle behavioral state determiner that determines a vehicle behavioral state in a detecting area based on a count value in the behavior determination clock counter.

2. The low power operated loop type vehicle detecting apparatus as claimed in claim 1, wherein the count controller controls the behavior determination clock generator so as to stop a generation of the behavior determination clock at a time period out of the clock count time.

3. A low power operated loop type vehicle detecting apparatus, comprising:

a resonance oscillation circuit unit that includes an LC resonator having a loop coil mounted in a detecting area and an oscillator connected with the LC resonator and generates an analog oscillation signal having a frequency determined according to an inductance value of the loop coil;

a vehicle behavior be unit that determines a vehicle behavior in a detecting area based on the analog oscillation signal output from the resonance oscillation circuit unit;

an analog-digital converter that converts an analog oscillation signal output from the resonance oscillation circuit, unit into a digital oscillation signal;

a counter controller that periodically turns-on/off operating voltage supplied to the oscillator and sets clock count time based on a digital oscillation signal period corresponding to a steady-state period of an analog oscillation signal output to the resonance oscillation circuit unit in the digital oscillation signal output from the analog-digital converter;

a behavior determination clock counter that counts the digital oscillation signal generated in the analog-digital converter for the clock count time set in the count controller; and a vehicle behavioral state determination unit that determines a vehicle behavioral state in a detecting area based on the count value in the behavior determination clock counter.

4. The low power operated loop type vehicle detecting apparatus as claimed in claim 3, wherein the analog-digital converter generates a divider digital oscillation signal having a 1/N (N=integer of 2 or more) frequency of the analog oscillation signal output from the resonance oscillation circuit unit; and the count controller sets the clock count time by using count starting pulse position information that indicates whether the count starting pulse at which the count of the behavior determination clock counter starts corresponds to an n-th pulse, starting from the first pulse of the divider digital oscillation signal and count ending pulse position information that indicates whether the count ending pulse at which the count of the behavior determination clock counter ends corresponds to an n-th pulse, starting from the first pulse of the divider digital oscillation signal.

* * * * *